US006866530B1

(12) United States Patent
Yen-Lin

(10) Patent No.: US 6,866,530 B1
(45) Date of Patent: Mar. 15, 2005

(54) MEMORY CARD CONNECTOR

(75) Inventor: Chen Yen-Lin, Taoyuan (TW)

(73) Assignee: Amphenol Taiwan Corporation, Taoyuan (TW)

( * ) Notice: Subject to any disclaimer, the term of this patent is extended or adjusted under 35 U.S.C. 154(b) by 0 days.

(21) Appl. No.: 10/813,022

(22) Filed: Mar. 31, 2004

(51) Int. Cl.[7] ..... H01R 13/62
(52) U.S. Cl. ..... 439/326
(58) Field of Search ..... 439/630, 326, 439/607, 188

(56) References Cited

U.S. PATENT DOCUMENTS 6,210,193 B1 * 4/2001 Ito et al. ..... 439/326
6,231,364 B1 * 5/2001 Liu ..... 439/326
6,390,850 B2 * 5/2002 Yoshimura et al. ..... 439/607
6,540,539 B2 * 4/2003 Yahiro et al. ..... 439/326
6,709,281 B2 * 3/2004 Shishikura et al. ..... 439/188
6,749,450 B1 * 6/2004 Chen ..... 439/188

* cited by examiner

*Primary Examiner*—Tho D. Ta
(74) *Attorney, Agent, or Firm*—Troxell Law Office PLLC

(57) ABSTRACT

A memory card connector for mounting on a printed circuit board to electrically connect with a memory card, includes an insulative housing being generally a flat cuboid with a lower wall and three side walls thereby defining a receiving space with an opening end. A plurality of receiving grooves is defined in the lower wall. A plurality of terminals is received in the receiving grooves of the housing. Each terminal has a contact portion, an interferential portion and a soldering portion. The soldering portion is located at the opening end of the housing. The contact portion is away from the opening end of the housing and slightly projects from the receiving groove. A shielding plate is covered on the housing. The shielding plate and the lower wall receiving the contact portions of the terminals cooperatively define an insertion slot. Whereby the memory card connector electrically connects with the memory card through slantwise inserting the memory card thereto and then rotating the memory card to be received in the receiving space of the housing and to press against the terminals.

6 Claims, 3 Drawing Sheets

MEMORY CARD CONNECTOR

BACKGROUND OF THE INVENTION

1. Field of the Invention

The present invention relates to a memory card connector, and particularly to a memory card connector electrically connecting with a memory card through slantwise inserting the memory card thereto and rotating the memory card to be received in the memory card connector thereby saving operation space of connecting the memory card to the memory card connector.

2. Prior Art

As a demand in the market and a trend of development of technological products, more and more information appliances are emphasized with functions and convenience in use. As one kind of typical information appliances each of which is portable and miniaturized but has a high data capacity, a memory card is currently and widely applied in a digital camera, a notebook computer, a personal digital assistance (PDA) and a mobile phone. It is well known that the memory card is electrically connected with a memory card connector for data transmission between the memory card and an information appliance having the memory card connector. In general, the memory card is inserted into the conventional memory card connector with a horizontal direction for electrical connection each other and so the conventional memory card connector is mounted on a periphery of the information appliance for having a relatively large operation space of inserting the memory card. Therefore, the memory card connector has to be mounted on a periphery of a printed circuit board (PCB) of the information appliance. However, since the PCB layout has to be designed with the memory card connector on a periphery thereof, the PCB is restricted due to the memory card connector. Furthermore, the conventional memory card connector adversely affects the innovation of the PCB and the information appliance.

Moreover, terminals of the conventional memory card connector are perpendicular to the insertion direction of the memory card, which adversely affects the memory card pressing against the terminals. So, the stability of the electrical connection between the terminals and the memory card is adversely affected.

SUMMARY OF THE INVENTION

Accordingly, an object of the present invention is to provide a memory card connector electrically connecting with a memory card through slantwise inserting the memory card thereto and then rotating the memory card to be received therein and to press against the terminals of the connector thereby ensuring stability of the electrical connection between the memory card and the memory card connector, saving operation space of inserting or drawing the memory card and providing an innovative manner of inserting or drawing the memory card.

To achieve the above-mentioned object, a memory card connector in accordance with the present invention for mounting on a printed circuit board to electrically connect with a memory card, a shielding plate is covered on the housing. The shielding plate and the lower wall receiving the contact portions of the terminals cooperatively define an insertion slot. A guiding surface is formed at the lower wall of the housing within the insertion slot whereby the memory card connector is able to electrically connect with the memory card through slantwise inserting the memory card thereto and then rotating the memory card to be received in the receiving space of the housing and to press against the terminals.

Other objects, advantages and novel features of the present invention will be drawn from the following detailed embodiment of the present invention with attached drawings, in which:

DESCRIPTION OF THE PREFERRED EMBODIMENTS

Figure 1:
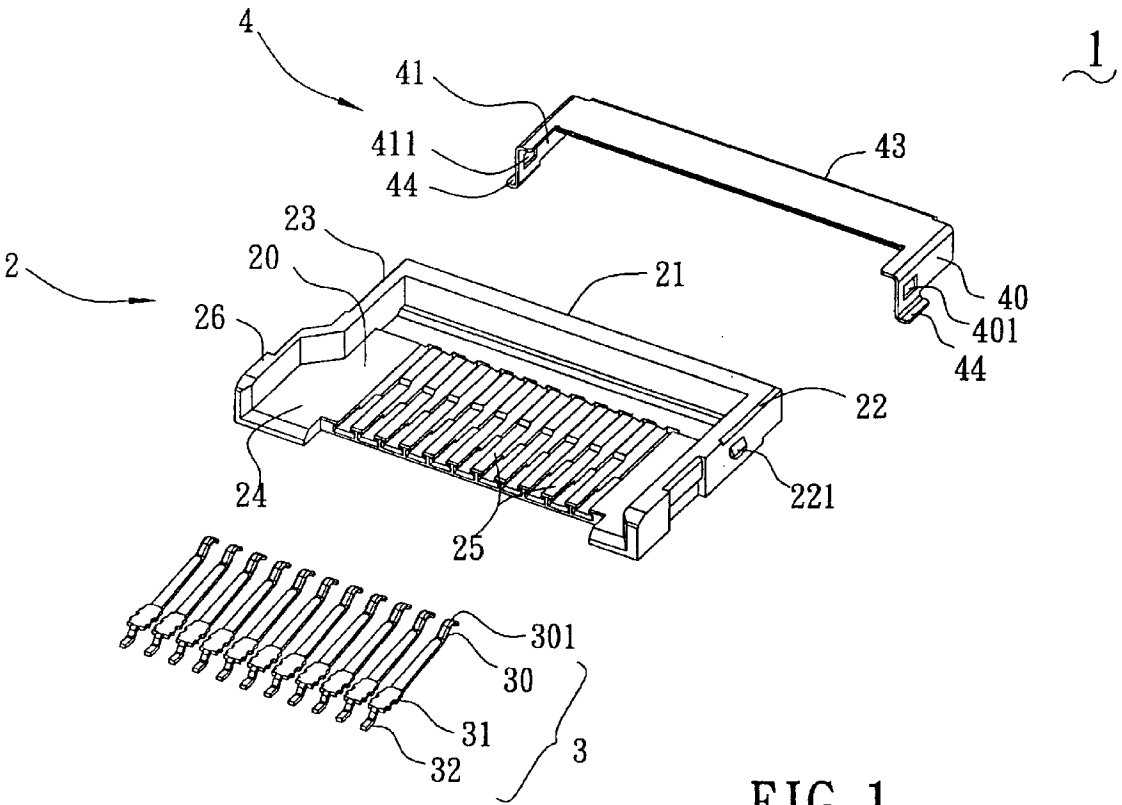
FIG. 1 is an exploded view of a memory card connector of the present invention.
Figure 2:
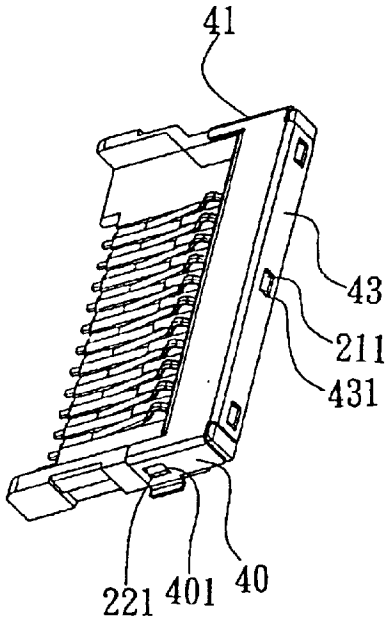
FIG. 2 is an assembled view of FIG. 1.

Referring to FIGS. 1 and 2, a memory card connector 1 of the present invention includes an insulative housing 2, a plurality of terminals 3 and a shielding plate 4. The housing 2 is generally a flat cuboid with a lower wall 20, a longitudinal side wall 21, and two lateral side walls 22, 23 respectively connecting with opposite ends of the lower wall 20 and the longitudinal side wall 21 thereby defining a receiving space with an opening end 24. A plurality of receiving grooves 25 is defined in the lower wall 20 for receiving the terminals 3. Three tabs 211, 221, 231 are respectively formed at the longitudinal sidewall 21 and the lateral sidewalls 22, 23 (see FIGS. 2–3) for engaging with the shielding plate 4. An expanded portion 26 is formed at the lateral side wall 23 corresponding to the configuration of a memory card 6 (see FIG. 3) thereby preventing misconnection between the memory card 6 and the memory card connector 1.

The terminals 3 are received in the receiving grooves 25 and each has a contact portion 30, an interferential portion 31 and a soldering portion 32. The soldering portion 32 is located at the opening end 24 of the housing 2 and is bent to be generally horizontal for soldering to a printed circuit board (PCB) 7 (see FIGS. 4–5) through surface mounting technology (SMT). The interferential portion 31 extending from the soldering portion 32 is interferentially engaged with and received in the receiving groove 25. The contact portion 30 extends from the interferential portion 31 and is away from the opening end 24 of the housing 2. A contact surface 301 is formed at the contact portion 30 and slightly projects from the receiving groove 25 for electrically contacting a corresponding contact pad 60 of the memory card 6.

The shielding plate 4 has two lateral flanges 40, 41 and a longitudinal flange 43 between the lateral flanges 40 (see FIG. 2). A recesses 401, 411, 431 are respectively defined in the lateral flanges 40, 41, 43 for respectively engaging with the tabs 221, 231, 211 of the lateral sidewalls 22, 23 and the longitudinal sidewall 21. The shielding plate 4 and the lower wall 20 receiving the contact portions 30 of the terminals 3 cooperatively defines an insertion slot 42 (see FIG. 4) for insertion of the memory card 6. A guiding surface 421 is formed at the lower wall 20 of the housing 2 within the insertion slot 42 for guiding the slantwise inserting memory card 6. Two soldering pads 44 respectively extend from the lateral flanges 40, 41 and are bent to be generally horizontal for soldering to the PCB 7 through surface mounting technology (For short is SMT).

Figure 3:
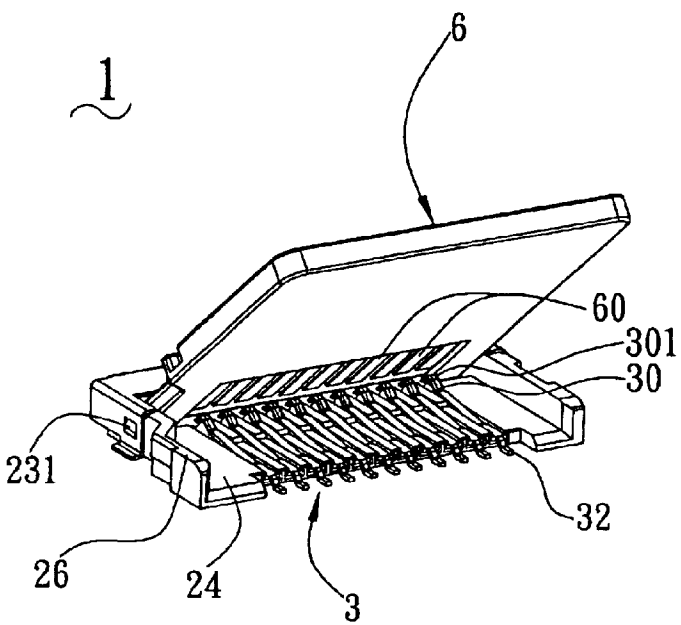
FIG. 3 is a perspective view showing a memory card being slantwise inserted to the memory card connector of the present invention.
Figure 4:
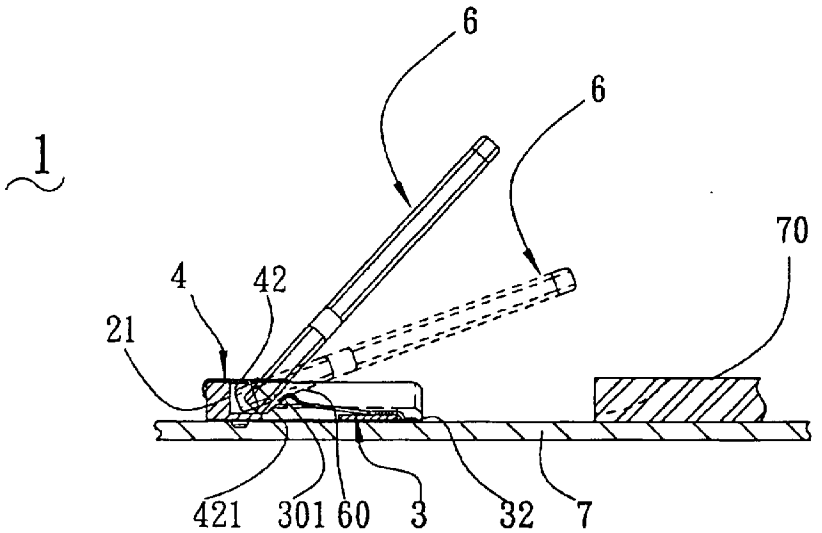
FIGS. 4 and 5 are schematic views showing the memory card being slantwise inserted to the memory card connector and then being rotated to be received in the memory card connector.
Figure 5:
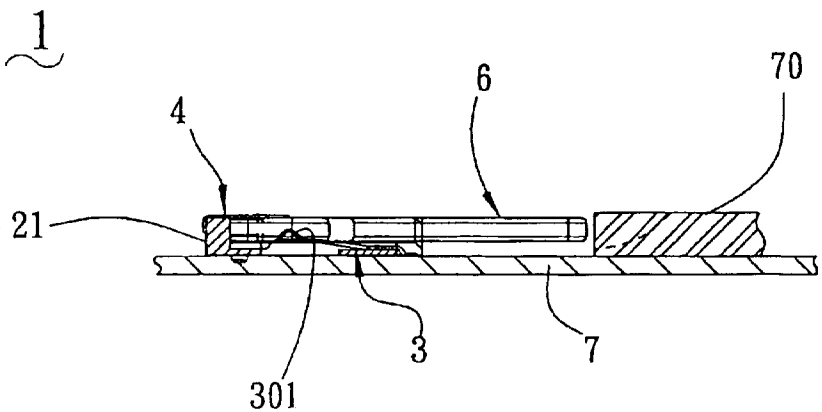

Referring to FIG. 3, it is a perspective view showing the memory card 6 being inserted to the memory card connector 1 of the present invention. Referring to FIGS. 4–5, in use, the memory card 6 is slantwise inserted to the insertion slot 42 of the memory card connector 1 and then is rotated to be received in the receiving space of the housing 2 with the contact pads 60 gradually pressing against the contact surfaces 301 of the terminals 3 during the rotation of the memory card 6 thereby electrically connecting with the memory card connector 1. Thus, when the memory card connector 1 of the present invention is mounted on the PCB 7, the memory card connector 1 is configurable adjacent to other component 70 with a relatively small operation space of inserting or drawing the memory card 6. That's, the memory card 6 is slantwise inserted into the insertion slot 42 with the guidance of the guiding surface 421, then the memory card 6 is rotated toward the lower wall 20 of the housing 2 (shown in broken lines in FIG. 4) and then the memory card 6 is received in the receiving space of the housing 2, as shown in FIG. 5 whereby the contact pads 60 of the memory card 6 electrically contact the contact surfaces 301 of the contact portions 30 of the terminals 3 respectively. Since the memory card 6 is rotated to press against the contact portions 30 of the terminals 3, the contact pads 60 stably contact the contact surfaces 301 of the terminals 3 thereby ensuring the stability of electrical connection between the memory card 6 and the memory card connector 1. Furthermore, the memory card connector 1 saves the operation space of inserting or drawing the memory card 6 relative to the conventional memory card connector, which the memory card 6 is inserted into or drawn from in one direction. Moreover, the memory card connector 1 of the present invention provides an innovative manner of inserting or drawing the memory card 6.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A memory card connector for mounting on a printed circuit board (PCB) to electrically connect with a memory card, comprising:

a) an insulative housing being generally a flat cuboid with a lower wall and three sidewalls thereby defining a receiving space with an opening end, a plurality of receiving grooves being defined in the lower wall;

b) a plurality of terminals received in the receiving grooves of the housing, each terminal having a contact portion, an interferential portion and a soldering portion, the soldering portion being located at the opening end of the housing, the contact portion being away from the opening end of the housing and slightly projecting from the receiving groove; and c) a shielding plate covered on the housing, the shielding plate and the lower wall receiving the contact portions of the terminals cooperatively defining an insertion slot;

wherein the three side walls of the housing comprise a longitudinal side wall, and two lateral side walls respectively connecting with opposite ends of the lower wall and the longitudinal side wall.

2. The memory card connector as claimed in claim 1, wherein an expanded portion is formed at the lateral side wall corresponding to the configuration of the memory card thereby preventing misconnection between the memory card and the memory card connector.

3. The memory card connector as claimed in claim 2, wherein the shielding plate has two lateral flanges and a longitudinal flange between the lateral flanges, a tabs are respectively formed at the longitudinal side wall and the lateral side walls, and a recesses are respectively defined in the lateral flanges for respectively engaging with the tabs of the lateral side walls and the longitudinal side wall.

4. The memory card connector as claimed in claim 3, wherein a soldering pads respectively extend from the lateral flanges of the shielding plate.

5. The memory card connector as claimed in claim 4, wherein the soldering pads and the soldering portions of the terminals are bent to be generally horizontal for soldering to the PCB through surface mounting technology.

6. A memory card connector for mounting on a printed circuit board (PCB) to electrically connect with a memory card, comprising:

a) an insulative housing being generally a flat cuboid with a lower wall and three sidewalls thereby defining a receiving space with an opening end, a plurality of receiving grooves being defined in the lower wall;

b) a plurality of terminals received in the receiving grooves of the housing, each terminal having a contact portion, an interferential portion and a soldering portion, the soldering portion being located at the opening end of the housing, the contact portion being away from the opening end of the housing and slightly projecting from the receiving groove; and c) a shielding plate covered on the housing, the shielding plate and the lower wall receiving the contact portions of the terminals cooperatively defining an insertion slot;

wherein a guiding surface is formed at the lower wall of the housing within the insertion slot for guiding the slantwise inserting memory card.

* * * * *